United States Patent [19]

Bothner

[11] Patent Number: 4,568,075

[45] Date of Patent: Feb. 4, 1986

[54] SHEET REGISTRATION AND CLAMPING APPARATUS

[75] Inventor: Carl R. Bothner, Rochester, N.Y.

[73] Assignee: Eastman Kodak Company, Rochester, N.Y.

[21] Appl. No.: 669,701

[22] Filed: Nov. 8, 1984

[51] Int. Cl.[4] ..... B65H 7/02

[52] U.S. Cl. ..... 271/227; 271/245

[58] Field of Search ..... 271/245, 246, 247, 227, 271/228, 232, 243, 244, 227

[56] References Cited

U.S. PATENT DOCUMENTS

| | | | |
|---|---|---|---|
| 116,616 | 7/1871 | Mauger . | |
| 1,495,257 | 5/1924 | Dudley . | |
| 3,671,035 | 6/1972 | Reist | 271/204 X |
| 4,024,814 | 5/1977 | Becker . | |
| 4,330,117 | 5/1982 | Weisbach | 271/245 X |
| 4,354,673 | 10/1982 | Kuroda | 271/245 X |
| 4,402,266 | 9/1983 | Sugiyama | 271/245 X |

*Primary Examiner*—Richard A. Schacher
*Attorney, Agent, or Firm*—Larry P. Kessler

[57] ABSTRACT

Apparatus for sequentially registering a sheet, movable along a travel path, relative to such travel path, clamping such sheet at its registered location and guiding such sheet as it moves from its registered location. Such apparatus comprises an elongated member having a sheet registration portion, a sheet clamping portion, and a sheet guiding portion. The elongated member is sequentially moved relative to the sheet travel path to: a first position where the registration portion intercepts and stops a sheet moving along the travel path at a registration location to effect registration of the sheet, and the sheet clamping portion and sheet guiding portion are inoperative; a second position where the sheet clamping portion secures the registered sheet at such registration location; and a third position where the clamping portion releases the registered sheet, and the sheet guiding portion guides the sheet as it moves away from the registration location.

8 Claims, 15 Drawing Figures

FIG. 3
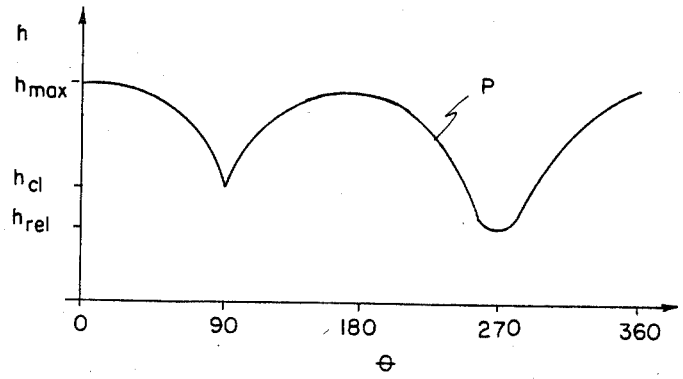
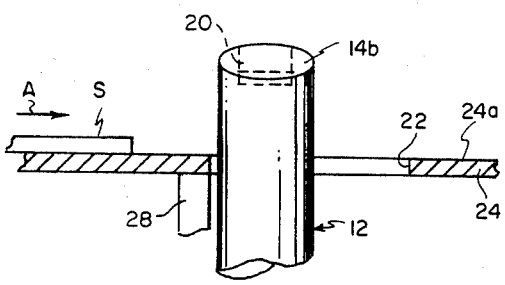
FIG. 4b
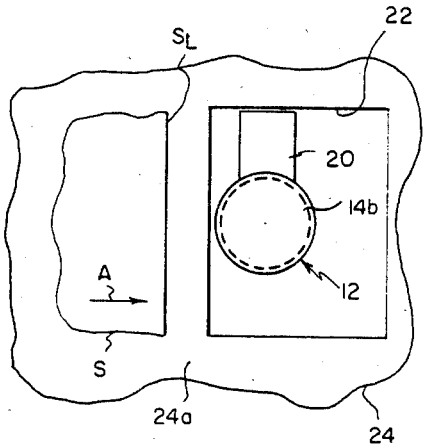
FIG. 4a

SHEET REGISTRATION AND CLAMPING APPARATUS

BACKGROUND OF THE INVENTION

This invention relates generally to sheet registration and clamping apparatus, and more particularly, to apparatus which sequentially registers a sheet at a registration location, clamps such sheet at such location, and guides such sheet as it is moved from such location.

In certain reproduction apparatus, such as printers or duplicators, copies of information are reproduced on cut sheets of paper. Typically, the paper sheets are fed seriatim to a support where they are registered and clamped to the support. The support retains the sheet in its registered location while an operation is carried out on such sheet. For example, the support may be moved into engagement with a printing platen where marking particles or ink, in an imagewise pattern corresponding to information to be reproduced, are transferred to the sheet. The sheet is thereafter transported from the support to apparatus for fixing the transferred pattern to the sheet to form the desired reproduction.

Prior reproduction apparatus employ many different mechanisms for registering and clamping a sheet to the support. Most commonly, the mechanisms include a plurality of clamps mounted on the support, each clamp having a registration portion and a portion extending from the registration portion in a direction upstream of the travel of a sheet toward the registration portion. As a sheet is registered against the registration portions, the extending portions are moved to clamp the lead edge of the registered sheet between such extending portions and the support. Such mechanisms are generally effective to carry out their intended registration and clamping functions. However, if there is significant curl in the lead edge of a sheet being registered, the extending portions of the mechanisms can interfere with movement of the sheet toward the registration portions. Moreover, the lead edge of a registered sheet must somehow be lifted over the extending portions on transport of the sheet away from the mechanism after the work operation (e.g., image transfer) is performed on the registered sheet.

SUMMARY OF THE INVENTION

This invention is directed to apparatus for sequentially registering a sheet, movable along a travel path, relative to such travel path, clamping such sheet at its registered location and guiding such sheet as it moves from its registered location. Such apparatus, which overcomes the aforementioned difficulties associated with prior sheet registration and clamping mechanisms, comprises an elongated member having a sheet registration portion, a sheet clamping portion, and a sheet guiding portion. The elongated member is sequentially moved relative to the sheet travel path to first, second and third positions. In the first position, the registration portion intercepts and stops a moving sheet at a registration location to effect registration of the sheet, and the sheet clamping portion and sheet guiding portion are inoperative. In the second position, the sheet clamping portion secures the registered sheet at such registration location. In the third position the clamping portion releases the registered sheet, and the sheet guiding portion guides the sheet as it moves away from the registration location.

The invention, and its objects, and advantages, will become more apparent in the detailed description of the preferred embodiment presented below.

BRIEF DESCRIPTION OF THE DRAWINGS

In the detailed description of the preferred embodiment of the invention, reference is made to the accompanying drawings, in which:

FIG. 3 is a graphical representation of the movement of the sheet registering, clamping and guiding apparatus according to this invention plotted as the vertical movement of such apparatus (h) vs. the angle of rotation of such apparatus ($\theta$);

FIGS. 4A through 9A and 4B through 9B are plan views and side elevational views respectively of the sheet registering, clamping and guiding apparatus according to this invention taken at sequential stages in the operation of such apparatus.

DESCRIPTION OF THE PREFERRED EMBODIMENT

Figure 2:
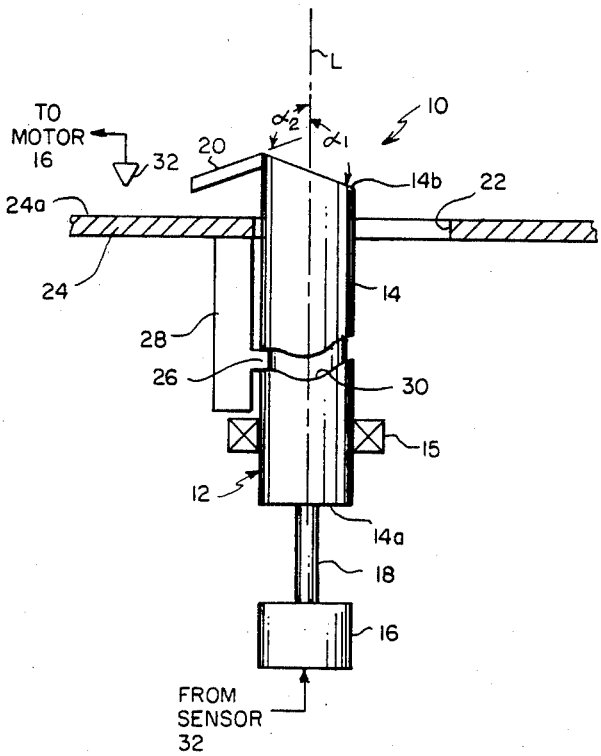
FIG. 2 is a side elevational view, partly in cross-section, of the sheet registering, clamping and guiding apparatus of FIG. 1, taken along lines 2—2 of FIG. 1.
Figure 1:
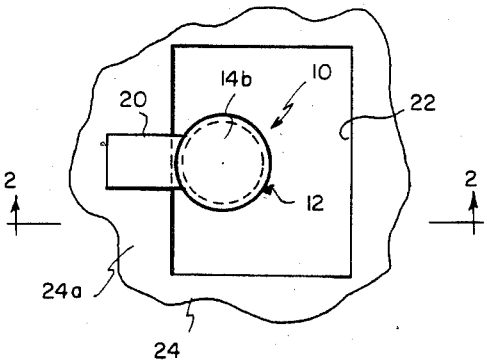
FIG. 1 is a plan view of the sheet registering, clamping and guiding apparatus according to this invention.

Referring now to the accompanying drawings, the sheet registering, clamping and guiding apparatus is generally designated by the numeral 10. As best shown in FIGS. 1 and 2, the apparatus 10 comprises an elongated member 12 including a sheet registration portion defined by a shank 14 of substantially circular cross-section. The shank 14 is supported in bearings 15 for reciprocation along, and rotation about, its longitudinal axis L. A rotary motor 16 has an output shaft 18 operatively coupled to end 14*a* of the shank 14 to selectively rotate the shank about its longitudinal axis L. The opposite end 14*b* of the shank 14, defining a sheet guiding portion, is formed as a planar surface oriented at an angle $\alpha_1$ to the longitudinal axis of such shank. A sheet clamping portion, defined by member 20, is connected to the shank 14 adjacent to the end 14*b* at its highest point. The member 20 extends substantially radially from the shank 14 and lies in a plane intersecting the longitudinal axis of the shank at an angle $\alpha_2$, for example, substantially equal to the angle $\alpha_1$ of surface 14*b*. While the apparatus 10, according to this invention, is described as comprising a single elongated member, it is, of course, apparent that any appropriate member number of similarly constructed elongated members may be utilized in the apparatus.

The elongated member 12 is located to extend through an opening 22 in a plate 24 having a surface 24*a* for supporting a sheet and defining a sheet travel path. The plate 24 may be, for example, a sheet support of a printer or duplicator and as such may be planar or curvi-linear. The longitudinal axis L of the shank 14 of the elongated member is substantially perpendicular to the plane of the sheet supporting surface 24*a* and intercepts the travel path of a sheet movable along such surface. A stationary pin 26 extends from a support member 28 fixed to the undersurface of the plate 24. The pin 26 is received in a circumferential groove 30 formed in the shank 14. The groove 30 has a profile such that, on rotation of the shank 14 about its longitudinal axis L, the cooperation of the pin 26 and groove 30 causes the shank to reciprocate along its longitudinal axis relative to the plane of surface 24*a* for the purpose to be explained hereinbelow. FIG. 3 graphically shows a plot P of the reciprocation of the shank 14 of the elongated member 12 as the shank rotates about its longitudinal axis. That is, the plot P represents the vertical movement, designated as h, of the topmost portion of surface 14*b* relative to the plane of surface 24*a* at the corresponding angular positions of the shank, designated $\theta$, starting from its position shown in FIG. 4.

In the operation of the apparatus 10, the shank 14 of the elongated member 12 is rotated by the motor 16 to its initial position as shown in FIG. 4A. This is the position where $\theta$ equals 0° in FIG. 3, with the surface 14*b* being located at its maximum elevation $h_{max}$ above the plane of surface 24*a*. At the initial position, the shank 14 intercepts the travel path of a sheet S delivered to the plate 24 and traveling along a path in the direction of arrow A along the surface 24*a* of plate. On engagement of the sheet with the shank, the sheet is stopped at a registration location. Moreover, in such initial position, the clamping member 20 and the surface 14*b* are significantly above the plane surface 24*a* and directed relative to the sheet travel path so as to be in an inoperative relation to such path. Therefore, the clamping member does not interfere with sheet movement to its registration location (i.e., into engagment with shank 14).

Figure 5B:
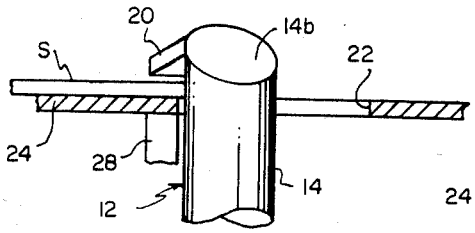
Figure 5A:
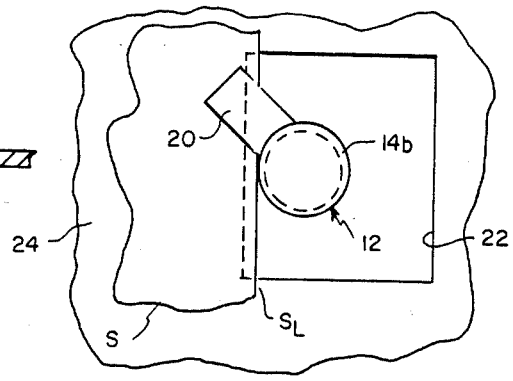
Figure 6B:
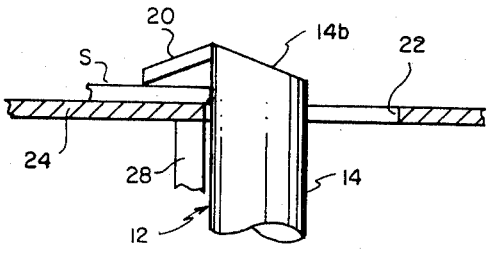
Figure 6A:
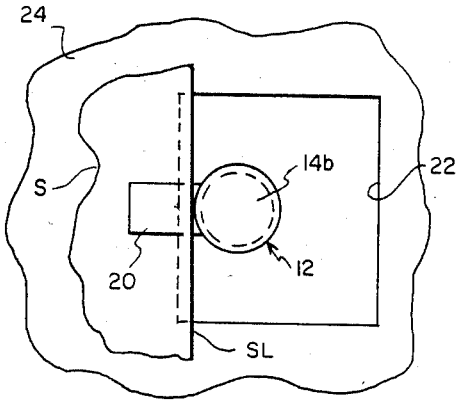
Figure 7B:
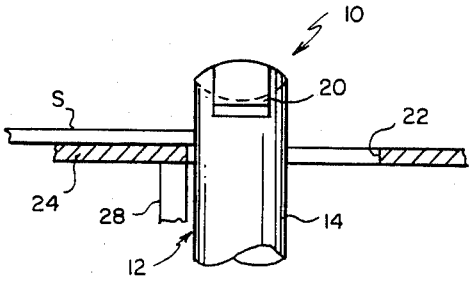
Figure 7A:
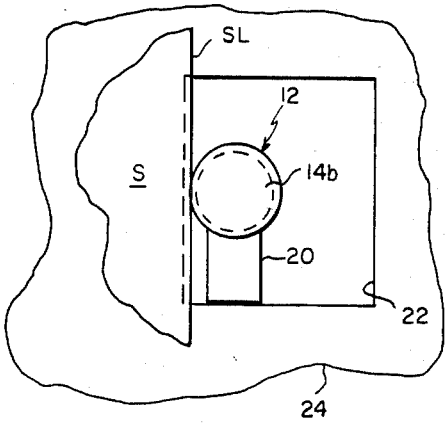
Figure 8B:
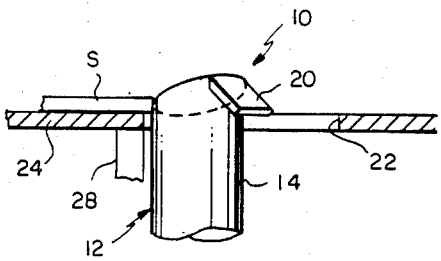
Figure 8A:
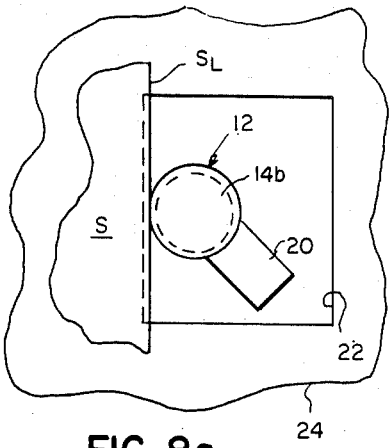

A sensor 32, such as a photoelectric device or a mechanical switch, detects the lead edge of a sheet moving into engagement with the shank 14 and generates a signal upon such detection. Such. signal is used to actuate motor 16. Thus, in response to the movement of a sheet S along the surface 24*a* into engagement with the shank 14 of the elongated member 12, the motor 16 is actuated to rotate the shank from the initial position (in a counterclockwise direction when viewing FIGS. 4A through 9A). As described above, on rotation of the shank, the stationary pin 26 cooperates with the groove 30 to reciprocate the shank along its longitudinal axis L according to the profile of the groove. Rotation of the shank 14 to the position of FIGS. 5A, 5B ($\theta$ equals 45°) brings the clamping member 20 over such lead edge at an elevation significantly above the sheet on the plate 24. The clamping member is thus prevented from damaging the lead edge of the registered sheet. Continued rotation of the shank to the position of FIGS. 6A, 6B ($\theta$ equals 90°) results in the clamping member 20 being reciprocated toward the plate 24 to secure (clamp) the sheet S at its registration location. After clamping is effected, the motor 16 is deactuated and rotation of the shank is interrupted. Due to the profile of groove 30, reciprocation of the shank to its clamping position (designated $h_{CL}$ in FIG. 3) is rapidly and smoothly accomplished to assure proper clamping of the sheet without damage to such sheet. Thereafter, any required operation on the sheet, (for example, image transfer to such sheet) can then be effected with the sheet remaining in its registered location clamped to plate 24.

Subsequent to such operation on the sheet, the motor 16 is reactuated to further rotate the shank 14 of the elongated member 12 in the same (counterclockwise) direction. During such further rotation to the position of FIGS. 7A, 7B ($\theta$ equals 180°), the groove profile ensures that the shank is reciprocated in an upward direction to its maximum elevation above plate 24 (designated $h_{max}$ in FIG. 3) to move the clamping member 20 rapidly out of engagement with the sheet and release the sheet. When the clamping member 20 has fully cleared the lead edge S of the registered sheet (when viewed from above), further rotation of the shank to the position of FIGS. 8A, 8B ($\theta$ equals 225°) reciprocates such shank in a downward direction relative to the plate 24. In such position, the shank 14 is oriented about its longitudinal axis L to position the clamping member on the opposite side of the shank from the registered sheet, thereby preventing the clamping member from interfering with movement of the sheet from its registration location.

Figure 9B:
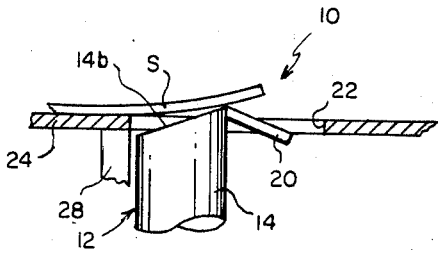
Figure 9A:
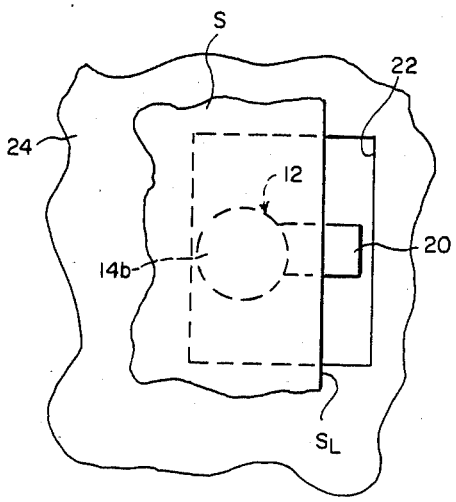

On rotation of the shank 14 to the position of FIGS. 9A, 9B ($\theta$ equals 270°), the profile of groove 30 causes such shank to be reciprocated to an elevation (designated $h_{REL}$ in FIG. 3). At such location, the surface 14*b* extends from below the level of surface 24*a* to above the level of such surface in the direction of travel of a registered sheet from its registration location. The motor 16 is again deactuated to interrupt rotation of the shank so that such shank remains in this position. The sheet is then moved downstream in the direction of arrow B away from its registered location. The surface 14b*b* serves as a guide surface for the sheet to assure the sheet clears the elongated member 12 without interference and without having to lift the sheet clamping members as required in prior mechanisms. After the sheet has cleared the elongated member 12, the motor 16 is reactuated to rotate shank 14 to return it to its initial position of FIGS. 4A, 4B ($\theta$ equals 0°). The elongated member 12 is thus ready for sequentially registering, clamping and guiding the next sheet delivered to the plate 24.

The invention has been described in detail with particular reference to a preferred embodiment thereof, but it will be understood that variations and modifications can be effected within the spirit and scope of the invention.

I claim:

1. Apparatus for sequentially registering a sheet, moving along a travel path, relative to such travel path, clamping such sheet at its registration location, and guiding such sheet as it moves from its registration location, said apparatus comprising:

an elongated member having a sheet registration portion, a sheet clamping portion, and a sheet guiding portion; and means for sequentially moving said elongated member relative to such travel path to first, second and third positions, wherein in said first position said registration portion intercepts and stops a sheet moving along such travel path at a location to effect registration of such sheet, and said sheet clamping portion and sheet guiding portion are inoperative; in said second position said sheet clamping portion secures such registered sheet at such registration location; and in said third position said clamping portion releases such registered sheet and said sheet guiding portion guides such sheet as it moves from the registration location.

2. The invention of claim 1 wherein said elongated member includes a shank of substantially circular cross-section forming said sheet registration portion, a clamping member extending substantially radially outwardly from said shank forming said sheet clamping portion, and a planar surface at one end of said shank oriented at an angle to the longitudinal axis of said shank forming said sheet guiding portion.

3. The invention of claim 2 wherein said elongated member moving means includes means for simultaneously rotating said shank about its longitudinal axis and reciprocating said shank along its longitudinal axis to sequentially orient said shank in said first, second and third positions.

4. The invention of claim 2 wherein said clamping member is connected to said shank adjacent to said one end of said shank in juxtaposition with the highest point of said planar surface.

5. The invention of claim 4 wherein said elongated member moving means includes means for simultaneously rotating said shank about its longitudinal axis and reciprocating said shank along its longitudinal axis to sequentially orient said shank whereby in said first position said shank intercepts such travel path, and said clamp forming member and said planar surface are substantially above the plane of a sheet in such travel path; in said second position said clamp forming member engages a registered sheet at the plane of a sheet in such travel path and clamps such sheet in such path; and in said third position said clamp forming member is released from engagement with such registered sheet and said planar surface is located to extend from below the plane of a sheet in such travel path to above such plane in the direction of sheet movement from its registered location.

6. Apparatus for sequentially registering a sheet moving along a support defining a travel path, relative to such travel path, clamping such sheet at its registration location, and guiding such sheet as it moves from its registration location, said apparatus comprising:

an elongated member including a shank of substantially circular cross-section adapted to extend through the support into such travel path, a clamping member extending substantially radially outwardly from said shank, and a planar surface at one end of said shank oriented at an angle to the longitudinal axis of said shank;

means for moving said shank for simultaneous rotation about and reciprocation along its longitudinal axis to sequentially locate said shank in (1) a first position wherein said shank intercepts and stops a sheet moving along such travel path at a location to effect registration of such sheet, and said clamping member and planar surface are remote from such travel path; (2) a second position wherein said clamping member secures such registered sheet to the support at such registration location; and (3) a third position wherein said clamping member is remote from such travel path to release such registered sheet and said planar surface is in relation to such travel path to guide such sheet as it moves from the registration location.

7. The invention of claim 6 wherein said clamping member is connected to said shank adjacent to said one end of said shank in juxtaposition with the highest point of said planar surface, whereby when said shank is in its third position said planar surface extends in a downstream direction from below the plane of a sheet in such travel path to above such plane, and said clamping member is directed in such downstream direction.

8. The invention of claim 6 wherein said shank moving means includes a motor operatively coupled to said shank for rotating said shank about its longitudinal axis, a circumferential groove defined in said shank and having a profile representing desired reciprocatory movement of said shank along its longitudinal axis for corresponding angular rotation of said shank, and a stationary pin cooperating with said groove, whereby said shank reciprocates a desired distance along such axis as said shank is rotated through a particular angle about such axis by said motor.

* * * * *